US005279055A

United States Patent [19]

Eckert et al.

[11] Patent Number: 5,279,055

[45] Date of Patent: Jan. 18, 1994

[54] STEAM IRON INCLUDING BOILER AND OVERLYING EXTRACTION CHANNEL

[75] Inventors: Lee H. Eckert, Cheshire; James E. Chasen, West Haven, both of Conn.

[73] Assignee: Black & Decker Inc., Newark, Del.

[21] Appl. No.: 796,517

[22] Filed: Nov. 21, 1991

[51] Int. Cl.[5] ..... D06F 75/18; H05B 3/00

[52] U.S. Cl. ..... 38/77.83; 219/254

[58] Field of Search ..... 38/74, 77.1, 77.5, 77.7, 38/77.8, 77.82, 77.83, 77.9, 88

[56] References Cited

U.S. PATENT DOCUMENTS

| | | | |
|---|---|---|---|
| 2,384,839 | 9/1943 | Kistner | 38/77.82 X |
| 2,437,571 | 3/1948 | Waage | 38/77.82 |
| 2,506,941 | 5/1950 | Scott | 38/77.82 |
| 2,815,592 | 10/1957 | Gomersall | 38/77.83 |
| 2,861,365 | 11/1958 | Block | 38/77.82 |
| 4,077,143 | 3/1978 | Walker et al. | 38/77.83 |
| 4,496,826 | 1/1985 | Osrow | 38/77.82 X |
| 4,837,952 | 6/1989 | Hennuy et al. | 38/77.7 |
| 5,115,117 | 5/1992 | Amiot et al. | 38/77.83 X |

FOREIGN PATENT DOCUMENTS

| | | | |
|---|---|---|---|
| 0905833 | 3/1971 | Canada | 38/77.83 |
| 0694935 | 12/1930 | France | 38/77.82 |
| 1030323 | 6/1953 | France | 38/77.82 |
| 0541061 | 10/1959 | France | 38/77.82 |
| 0129091 | 7/1985 | Japan | 38/77.83 |

*Primary Examiner*—Clifford D. Crowder
*Assistant Examiner*—Ismael Izaguirre
*Attorney, Agent, or Firm*—Barry E. Deutsch

[57] ABSTRACT

An electric steam iron includes a housing, a water reservoir, a boiler in fluid flow communication with the water reservoir, a soleplate, a steam cover overlying the soleplate in spaced relation thereto for defining a steam boiler chamber. An electrically operated heater is associated with the soleplate. A fluid control device regulates the flow of fluid from the reservoir to the steam boiler chamber. The chamber has a first portion for receiving water from the reservoir and a second portion. An extraction channel is formed overlying the second portion of the steam chamber. The steam cover has a first opening communicating the steam chamber with the extraction channel. The soleplate has a steam distribution chamber spaced from the steam boiler chamber. The steam cover has a second opening for communicating the extraction channel with the steam distribution chamber.

7 Claims, 2 Drawing Sheets

STEAM IRON INCLUDING BOILER AND OVERLYING EXTRACTION CHANNEL

BACKGROUND OF THE INVENTION

1. Field of the Invention

This invention relates to an electric steam iron and in particular, to a steam generating and extracting system for high rates of steam generation.

2. Background Information

Generally, most electric steam irons in use today employ a "flash" steam system wherein water contained in a water reservoir is dropped directly on a hot soleplate to generate steam. The generated steam is usually super-heated and its temperature is proportional to the soleplate temperature. It has been found that relatively high temperature super-heated steam is not as effective for ironing garments as steam at or near saturated conditions (100° C.). It has also been determined that saturated steam with some moisture content can relax the fabric of the garment being ironed and result in a more satisfactorily ironed garment. It has also been determined that the use of relatively high steam rates can significantly improve the ironing characteristics of many common fabrics.

Typically, in irons using the "flash" steam system, the steam is directed through a tortuous path to separate any entrained water from the steam. The typical tortuous path is reasonably effective for moderate steam rates, e.g. 10 grams of steam per minute. The effectiveness of a typical tortuous path however does not generally permit steam to be generated at all ironing temperatures or at relatively high steam rates. Generally, electric steam irons start to water spot at about 130°-135° C. at a steam rate of only 10 grams per minute. This shortcoming with conventional irons is particularly important since it has been found that superior ironing results for moisture sensitive fabrics such as cotton and cotton blends can be obtained by utilizing wet steam at lower than conventional temperatures, e.g. 110°-150° C. and at relatively high steam rates. These ironing conditions reduce the risk of scorching damage to the garment that can occur at the higher conventional ironing temperatures commonly used for cottons, e.g. 175°-195° C.

Additionally when using a higher steam rate such as 20 grams per minute at the higher temperatures conventionally used for cotton and cotton blends, e.g. 145°-175° C., water spotting can occur due to the limited effectiveness of typical tortuous paths and soleplate designs. These designs can typically only support high steam rates at the highest temperature settings of the iron e.g. 175°-205° C., without water spotting the garment.

There have been some attempts to overcome the foregoing problem by the use of very high steam chambers with tall vertical walls cast into the iron's soleplate. The very height of these walls under most circumstances prevents relatively large droplets of water from escaping the steam generating chamber. The foregoing, while being generally effective in reducing water spotting at high steam rates and low temperatures, adds significant expense to the cost of the iron, consumes much space, and adds a significant amount of weight which makes the iron less user friendly.

It is accordingly an object of this invention to generate relatively low temperature steam at relatively high steam rates without significantly increasing the height and/or weight of the iron.

SUMMARY OF THE INVENTION

The foregoing object and other objects of this invention are attained in an electric steam iron having a housing; a water reservoir mounted in the housing; a soleplate; a heater for said soleplate; a steam cover overlying said soleplate in spaced relation for defining a steam boiler chamber therebetween, the chamber having a first portion for receiving water from said reservoir and a second portion; fluid control means for regulating the flow of fluid from said water reservoir to said boiler chamber; means defining an extraction channel overlying the second portion of the steam chamber; the steam chamber cover having at least one opening for communicating the steam chamber with said extraction channel means; and the soleplate having at least one distribution chamber separated from the steam boiler chamber, the steam cover having at least a second opening for communicating the extraction channel means with the steam distribution chamber.

DESCRIPTION OF THE PREFERRED EMBODIMENTS

Referring now to the various figures of the drawings, a preferred embodiment of the invention shall now be described in detail. In referring to the various figures, like numerals shall refer to like parts.

Figure 1:
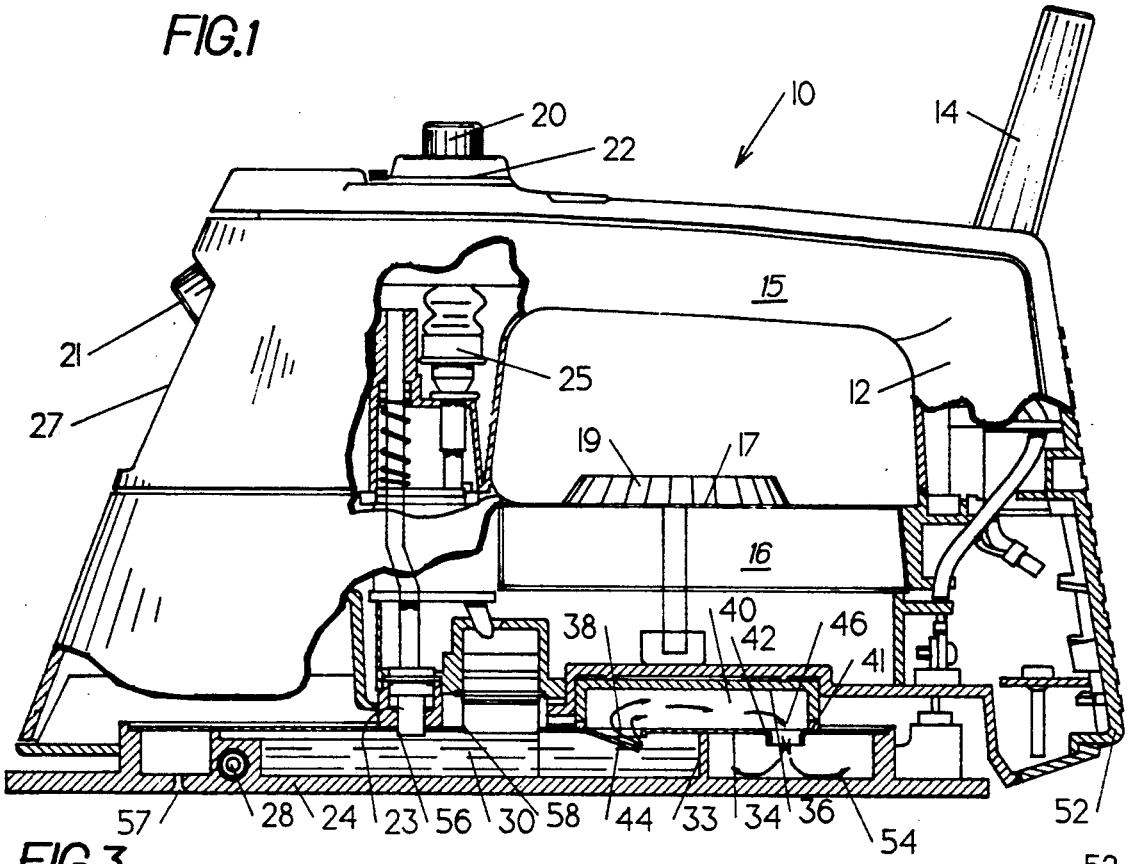
FIG. 1 is a longitudinal sectional view of an electric steam iron embodying the present invention.
Figure 2:
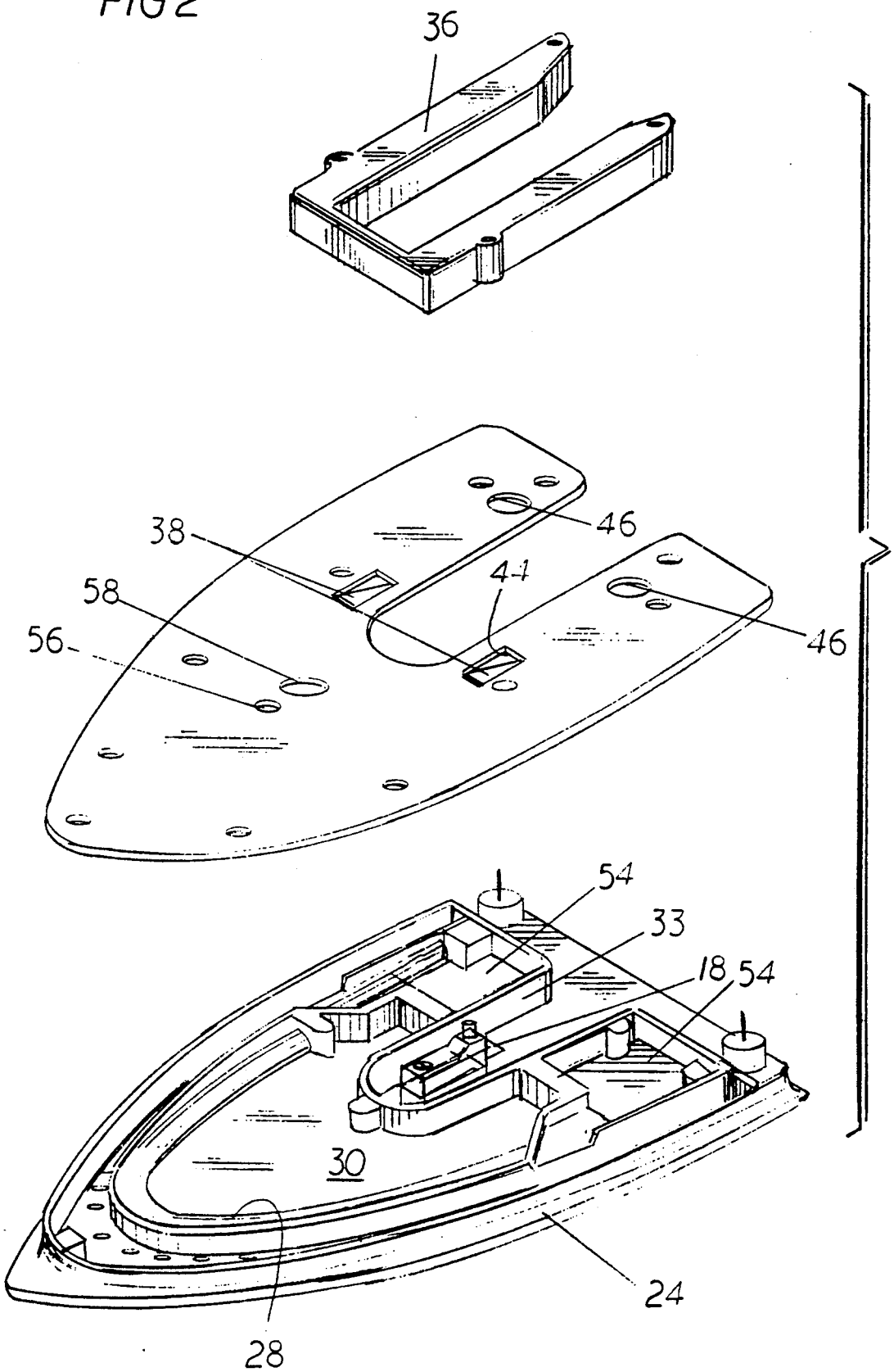
FIG. 2 is an exploded perspective view illustrating details of the invention.

Referring specifically to FIGS. 1 and 2 electric iron 10 includes a housing 12 formed from a suitable material such as polypropylene. An electric cord 14 extends from the rear of housing 12 and connects iron 10 to a source of electrical power. A water reservoir 16 is mounted or contained in housing 12. Housing 12 includes a handle 15 and a saddle portion 17. A thermostat 18 controls the operating temperature of heater 28. Control knob 19 located on saddle portion 17 is used to adjust thermostat 18. Heater 28 is operatively connected to soleplate 24. The temperature of the soleplate may be varied by the user of iron 10 through appropriate adjustment of the thermostat.

A second control knob 22 is mounted at the top forward portion of housing 12 and functions to regulate the operation of fluid control means 23. Fluid flow control means 23 meters the flow of fluid from water reservoir 16 into a steam boiler chamber 30.

A control button 20 is also mounted at the top of housing 12. Control button 20 operates a pump 25 which is used to inject a relatively large quantity of water into boiler chamber 30. The water is injected when a surge of steam is desired by the user. Pump 25 is also connected to a spray nozzle 21 located at the nose 27 of housing 12 for wetting fabric.

As noted previously, it is advantageous that iron 10 be capable of producing steam at lower than conventional temperatures and at relatively high rates as well as producing steam at relatively high temperatures. To achieve the foregoing desiderata, relatively large droplets or slugs of water must be separated from the steam, otherwise water spotting of the garment being ironed will take place.

To achieve the separation of water from the steam generated in steam boiler chamber 30, iron 10 of the present invention includes a steam cover plate 34. Cover plate 34 defines the upper surface of steam boiler chamber 30. Cover plate 34 includes a pair of openings 56, 58 which selectively communicate chamber 30 with reservoir 16 under control respectively of fluid control means 23 and surge control means 25. Cover plate 34 has a generally U-shaped housing 36 mounted on its top surface towards the rear portion thereof. Housing 36 defines an extraction channel 40. A pair of rectangular gaskets 41 provide a seal between each leg of housing 36 and cover plate 34.

Cover plate 34 includes a pair of laterally aligned openings 44. Each opening 44 is vertically aligned with one of the legs of housing 36. Each opening 44 includes a deflector formed as an inclined ramp 38. Ramps 38 extend downwardly from cover plate 34 into steam boiler chamber 30 for a reason to be more fully described hereinafter.

Cover plate 34 further includes a second pair of openings 46, positioned rearwardly of openings 44. Each opening 46 is vertically aligned with one of the legs of housing 36. Each opening 46 includes an inwardly extending diverter or rib 42. The purpose of rib 42 shall be more fully explained hereinafter.

The steam flowing through channel 40 passes through openings 46 into steam collection chambers 54. From collection chambers 54, the steam is distributed to ports 57 formed in the bottom wall of soleplate 24. The ends of each leg of U-shaped heater 28 are adjacent chambers 54.

When the user of iron 10 desires steam, the user operates either button 20 or knob 22 to obtain respectively either a surge of steam, or steam generated by the metering of water into chamber 30 via the operation of fluid control means 23.

The water delivered into chamber 30 is heated by heater 28 and is vaporized into steam when the temperature of the water reaches 100° C. or higher. The steam in chamber 30 flows towards the rear of iron 10 and thus contacts the front surface of ramp 38. Ramp 38 deflects any large water droplets entrained in the steam downwardly to separate the water droplets from the steam. The steam enters extraction channel 40 via openings 44 and passes rearwardly in the channel towards openings 46. Steam flows through openings 46 into outlet chambers 54. Outlet chambers 54 communicate across the top of the heater element with the steam distribution ports 57 formed in the soleplate.

Some slight cooling of the steam may occur inside channel 40. Thus, water droplets may form in the steam flowing through channel 40. Rib 42 prevents any droplets of water flowing through openings 46 from wicking along the bottom side of steam cover 34 and being distributed to the soleplate steam ports without touching the rear portion of the legs of heating element 28. Flange 42 directs the steam into chambers 54 to insure that any large slugs of water are transformed into steam before reaching the soleplate ports.

Any excessive moisture or condensation remaining in the steam flowing into chambers 54 is vaporized as the steam passes over the rear portion of the legs of heating element 28.

Openings 44 are spaced forwardly of the rear wall 33 forming chamber 30. When the operating iron is placed on heel rest 52, the space between wall 33 and openings 44 functions as a reservoir or trap for the water/steam remaining in chamber 30. The remaining water/steam slowly exits chamber 30 through openings 44, extraction channel 40, openings 46, chambers 54 and the soleplate 24.

When the steam rate becomes very high, a large pool of water is formed on the floor of chamber 30. Ramp 38 prevents the pool of water from easily exiting the chamber due to wave action and in addition deflects most water particles entrained in the steam. Boiler chamber 30 may become entirely flooded provided that heater 28 has enough wattage to produce steam across the entire wetted surface of the chamber and maintain the soleplate temperature while heat is being input to the fabric being ironed.

It has been shown experimentally that 1300 watts produces acceptable results with a steam rate of 20 grams per minute while ironing cotton broadcloth at a variety of operating temperatures. Less wattage was needed at lower steam rates.

Figure 3:
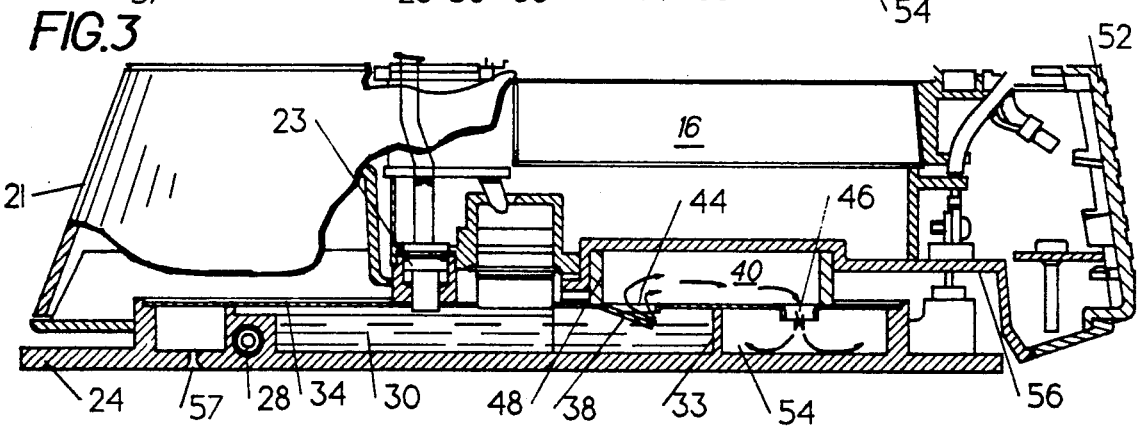
FIG. 3 is a partial longitudinal sectional view of an iron showing a second embodiment of the invention.

While the embodiment illustrated in FIGS. 1 and 2 require a separate housing 36 to form extraction channel 40, FIG. 3 illustrates an alternative embodiment in which the bottom surface of the plastic skirt 56 typically employed on an iron forms the roof of the channel. Rectangular gasket 48 which is held between the lower surface of skirt 56 and the top surface of steam cover plate 30 defines the ends of the channel and provides a suitable seal. The embodiment illustrated in FIG. 3 provides an extremely low cost means for implementing the invention.

Figure 4:
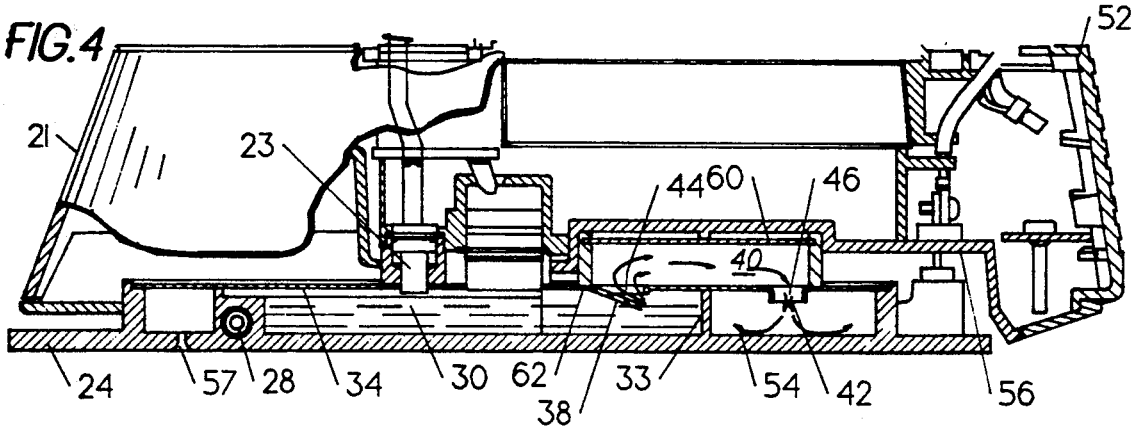
FIG. 4 is a view similar to the one illustrated in FIG. 3 showing yet another embodiment of the invention.

FIG. 4 illustrates yet another embodiment. A metal cover 60 is spaced below skirt 56 and is retained in a recessed groove formed in gasket 62. Cover 60 forms the top surface of boiler chamber 30.

While preferred embodiments of the present invention have been described and illustrated, the invention should not be limited thereto but may be otherwise embodied within the scope of the following claims.

What is claimed is:

1. An electric steam iron comprising:

a housing;

a water reservoir mounted in said housing;

a soleplate connected to said housing;

a steam cover overlying said soleplate in spaced relation thereto for encompassing a steam boiler chamber therebetween, said chamber having a first portion for receiving water from said reservoir and a second portion positioned rearwardly of said first portion;

an electrically operated heater associated with the soleplate;

fluid control means for regulating a flow of fluid from said water reservoir to said steam boiler chamber;

means comprising at least one extraction channel overlying said second portion of said steam boiler;

said steam cover having at least a first opening for communicating said steam boiler chamber with said extraction channel;

said soleplate having a steam distribution chamber separated from and positioned rearwardly of said steam boiler chamber, said steam cover having at least a second opening positioned rearwardly of said first opening for communicating said extraction channel with said steam distribution chamber; and means for directing the steam from said distribution chamber across said electronically operated heater to a plurality of steam distribution ports formed in said soleplate.

2. The steam iron in according with claim 1 wherein said steam cover includes first diverter means adjacent to said first opening and extending from said cover into said steam boiler chamber.

3. The steam iron in accordance with claim 2 wherein said second opening includes a downwardly extending second diverter means for preventing fluid flow from said second opening along a surface of said cover facing said second portion of said steam boiler chamber.

4. The steam iron in accordance with claim 3 wherein said steam boiler chamber includes means forming a reservoir for collecting water when the iron is oriented such that the soleplate is held in a vertically upward direction relative to a horizontal plane.

5. The steam iron in accordance with claim 2 wherein said steam boiler chamber includes means forming a reservoir for collecting water when the iron is oriented such that the soleplate is held in a vertically upward direction relative to a horizontal plane.

6. The steam iron in accordance with claim 1 wherein said second opening includes a downwardly extending diverter for preventing fluid flow from said second opening along a surface of said cover facing said second portion of said steam boiler chamber.

7. The steam iron in accordance with claim 1 wherein said steam boiler chamber includes means forming a reservoir for collecting water when the iron is oriented such that the soleplate is held in a vertically upward direction relative to a horizontal plane.

* * * * *